United States Patent [19]

Matsson

[11] 4,290,212

[45] Sep. 22, 1981

[54] WOODEN SHOE INCLUDING HINGE

[75] Inventor: Karl J. Matsson, Karlskrona, Sweden

[73] Assignee: Stiftelsen Blekinge Produkter, Karlskrona, Sweden

[21] Appl. No.: 126,713

[22] Filed: Mar. 3, 1980

[30] Foreign Application Priority Data

Mar. 6, 1979 [SE] Sweden ..... 7901989

[51] Int. Cl.[3] ..... A43B 13/08; A43B 1/06

[52] U.S. Cl. ..... 36/33; 36/86

[58] Field of Search ..... 36/33, 86, 85

[56] References Cited

U.S. PATENT DOCUMENTS

| | | | |
|---|---|---|---|
| 694,872 | 3/1902 | Lockett | 36/33 |
| 2,343,700 | 3/1944 | Pickens et al. | 36/33 X |
| 4,177,582 | 12/1979 | Ehrlich, Jr. | 36/33 |

FOREIGN PATENT DOCUMENTS

| | | | |
|---|---|---|---|
| 2265252 | 10/1975 | France | 36/86 |
| 23143 | 3/1913 | Norway | 36/33 |
| 73290 | 9/1916 | Switzerland | 36/33 |
| 79634 | 12/1918 | Switzerland | 36/33 |

*Primary Examiner*—James Kee Chi

[57] ABSTRACT

The disclosure relates to a shoe having a bottom of wood or other rigid material, the bottom being divided by means of a transverse section in the region between the sole and the shank of the shoe. The partition section makes an acute angle with the plane of the sole, and a slot is provided in each section surface for accommodating a hinge of flexible material. The edge of the shank is beveled adjacent to the partition section approximately at right angles thereto, a material piece being secured in the thus-formed V-shaped groove by gluing.

3 Claims, 1 Drawing Figure

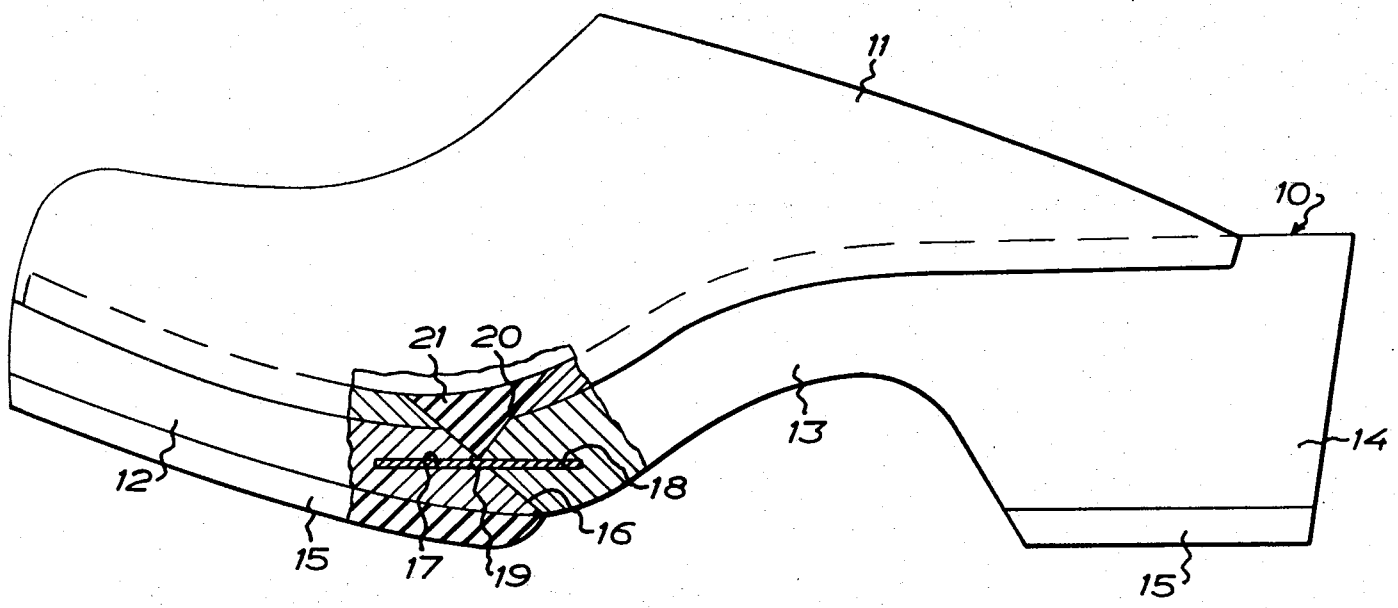
10
11
12
13
14
15
15
16
17
18
19
20
21

WOODEN SHOE INCLUDING HINGE

The present invention relates to a shoe with a bottom of wood or similar rigid material, the bottom forming a sole, shank and heel, and a leather upper or the like fixedly secured to the upper edge of the bottom, the bottom being divided along a section transversely of the shoe in the region between the sole and the shank, the two bottom portions produced thereby being interconnected by means of a hinge fixedly disposed in each section surface.

It is previously known to produce wooden shoes or clogs having an articulated bottom. The articulation is preferably placed in the region between the shank and the sole, since a location of the articulation ahead of this region would entail abnormal wear of the sole portion connected to the shank. The hinge consists of a normal metal hinge, which has proved to be disadvantageous as a result of rapid wear and of an undesirable increase in the weight of the clog. Another problem in this context is the gap above the hinge which opens and closes when the clog is in use.

The object of the present invention is to realize a clog provided with an articulated bottom, the clog obviating the above-outlined problems and being, moreover, considerably more comfortable to use while possessing long working life and being relatively economical in production. The object is attained in that the partition section between the shank and the sole makes an acute angle with the sole plane adjacent the section, that the upper side of the shank, adjacent the partition section and above the hinge slot is beveled approximately at right angles to the section for forming a groove in the inner surface of the bottom, and that the groove is filled with a yieldable material, for example foamed rubber or foamed plastics which adheres to the section surfaces. Preferably, the hinge consists of a piece of flexible material, suitably reinforced rubber or plastic material, which is secured in the hinge slots by gluing and/or nailing from the inside of the bottom.

The invention will be described in greater detail below with reference to the accompanying drawing which, in side elevation and partial section, illustrates one embodiment of the shoe according to the invention.

The clog shown on the drawing has a bottom 10 of wood and an upper 11 of leather or plastic connected in the normal manner to the bottom 10. Naturally, the bottom 10 may be manufactured of a material other than wood, and, similarly, the upper 11 may be of another design, for example, may consist of a number of straps secured in the upper edge of the bottom 10. The bottom 10 consists of a sole 12, a shank 13 connected thereto, and a heel 14 connected to the shank. The sole 12 and the heel 14 are provided, on their underside, with a wear resistant layer 15 of rubber or plastics.

As is apparent from the drawing, the bottom 10 is divided by means of a section 16 in the region between the sole 12 and the shank 13. The partition section 16 is planar and makes an acute angle with the plane of the sole. A slot 17 is milled in the section surface of the sole, and a corresponding slot 18 is milled in the section surface of the shank, this slot 18 being in register with the slot 17. The edge of the shank adjacent the section is beveled approximately at right angles to the section to form a groove 20 whose sides make substantially a right angle with each other.

The parts of the bottom 10 consisting of the sole 12, the shank 13 and the heel 14 are interconnected by means of a hinge 19 comprising a piece of flexible material, suitably reinforced rubber or plastic material, this material piece being inserted in the registering slots 17 and 18 and secured in place by gluing and/or nailing from the inside of the bottom 10. The groove 20 is filled with a resilient material, for example foamed rubber or foamed plastic. In practice, this is effected in that a material piece 21 of the same cross-sectional configuration and size as the groove 20 is connected, when the sole 12 and shank 13 assume the positions of rest illustrated on the drawing, to the walls of the groove 20 by means of gluing, preferably with an expanding glue. The material piece 21 is of the same length, or slightly longer than, the groove 20 and is shaped, after being secured in the groove, on the upper side and ends in accordance with the inner side and edge sides of the bottom 10.

It will be apparent from the above that the invention makes possible the production of a wooden clog with an articulated bottom in a very simple and, thereby, economical manner. A thus produced wooden clog is, moreover, highly wear-resistant and more comfortable to use than prior art wooden clogs with an articulated bottom, primarily thanks to the provision of the material piece 21 in the groove 20.

What I claim and desire to secure by Letters Patent is:

1. A shoe having an articulated connection in a bottom portion to which is attached an upper foot-receiving portion, said bottom portion comprising a heel portion;

a sole portion;

a shank portion having a front part and a rear part, said rear part connected to said heel portion and said front part connected to said sole portion;

said front part connection formed as two abutting planar surfaces, one of said planar surfaces formed on said sole portion and extending upwardly at a constant acute angle throughout said sole portion, the other planar surface formed on said front part of said shank portion and extending upwardly at an angle corresponding to said acute angle and terminating at an intermediate location along said one planar surface;

said front part of said shank portion having a beveled surface formed at right angles to said one planar surface to provide a groove extending upwardly from said terminating location;

a yieldable material fixedly mounted in said groove;

a first slot formed in said sole portion, said slot originating in said one planar surface immediately adjacent and below said terminating location and extending longitudinally into said sole portion;

a second slot aligned with said first slot, said second slot originating in said other planar surface and extending longitudinally into said shank portion; and a hinge member mounted in said first and second slots to extend therebetween and provide the articulated connection.

2. A shoe according to claim 1 wherein said hinge member is formed of flexible material.

3. A shoe according to claim 2 wherein said hinge member is fixedly mounted in said slots.

* * * * *